US005885140A

United States Patent [19]

Hakomori

[11] Patent Number: 5,885,140

[45] Date of Patent: Mar. 23, 1999

[54] SINGLE-SIDE ABRASION APPARATUS WITH DRESSER

[75] Inventor: Shunji Hakomori, Ayase, Japan

[73] Assignee: Speedfam Co., Ltd., Tokyo, Japan

[21] Appl. No.: 863,431

[22] Filed: May 27, 1997

[30] Foreign Application Priority Data

May 29, 1996 [JP] Japan ..... 8-157610

[51] Int. Cl.[6] ..... B24B 7/00

[52] U.S. Cl. ..... 451/72; 451/443

[58] Field of Search ..... 451/56, 72, 443; 279/3; 269/21

[56] References Cited

U.S. PATENT DOCUMENTS

| | | | |
|---|---|---|---|
| 5,205,082 | 4/1993 | Shendon et al. | 451/41 |
| 5,329,732 | 7/1994 | Karlsrud et al. | 451/289 |
| 5,398,459 | 3/1995 | Okumura et al. | 451/41 |
| 5,423,558 | 6/1995 | Koeth et al. | 451/21 X |
| 5,441,444 | 8/1995 | Nakajima | 451/289 |
| 5,476,414 | 12/1995 | Hirose et al. | 451/41 X |
| 5,486,131 | 1/1996 | Cesna et al. | 451/443 X |
| 5,527,209 | 6/1996 | Volodarsky et al. | 451/41 X |

FOREIGN PATENT DOCUMENTS

| | | | |
|---|---|---|---|
| 54 112091 | 9/1979 | Japan . | |
| 57-149158 | 9/1982 | Japan | 451/72 |
| 59 81054 | 5/1984 | Japan . | |

*Primary Examiner*—Timothy V. Eley

*Attorney, Agent, or Firm*—Oblon, Spivak, McClelland, Maier & Neustadt, P.C.

[57] ABSTRACT

An abrasion apparatus having a freely rotatable platen, an application block to which a workpiece is applied, and at least one pressing plate to press the workpiece on the platen with the application block being located therebetween. A working face of the platen is corrected by providing the pressing plate with a retaining ring to which the application block is fitted, which also serves as a dresser, and by pressing the retaining ring on the platen when the application block has been removed.

5 Claims, 2 Drawing Sheets

SINGLE-SIDE ABRASION APPARATUS WITH DRESSER

BACKGROUND OF THE INVENTION

1. Field of the Invention

This invention relates to a single-sided abrasion apparatus which abrades, by means of a platen, one side of a work piece having a substantially flat face, such as electronic parts like semiconductor wafers, glass wafers, magnetic disc bases, and others or mechine parts, and more particularly to a single-side abrasion apparatus that has the dresser to correct the working face of a platen.

2. Discussion of the Background

A single-side abrasion apparatus having a platen that is driven and freely rotated by a motor, an application block to which a work piece to be abraded is applied, and a plurality of pressing plates which press the work on the platen with the application block in between at the required processing pressure, has been widely known.

If such a single-side abrasion apparatus is used, the working face of the platen must be corrected regularly because abrasion precision is lowered by the worsening conditions of the working face: the evenness of the platen diminishes as the work piece is abraded, or if a pad is used, the pad is clogged or abraded nonuniformly, and the like.

In order to correct the working face of the platen, conventionally an exclusive dresser was separately provided and fitted in the pressing plates, then pressed on the platen.

However, if the exclusive dresser is mounted on or removed from the pressing plates as described above, mounting and removing the dresser is extremely troublesome and workability is poor; especially when an oversized single-side abrasion apparatus is used, the dresser is necessarily large and heavy, and as a dresser too large to be moved by one person is often used, thus making mounting and removing of the dresser more troublesome and dangerous.

Moreover, when the dresser is not used, it must be stored near the abrasion apparatus, which means that it is necessary to maintain space to store the dresser, and to transport the dresser.

SUMMARY OF THE INVENTION

The principal object of this invention is to provide a single-side abrasion apparatus with a dresser which can be operated easily and is highly safe, in which a heavy dresser need not be mounted on or removed from pressing plates each time a platen working face is corrected.

Another object of this invention is to provide a single-side abrasion apparatus with a dresser which does not require special care, space or the like to store and keep the same.

Still another object of this invention is to provide a single-side abrasion apparatus with a dresser that has a rational design in which a necessary member of the pressing plates necessarily doubles as a dresser.

In order to achieve the aforementioned objects, this invention provides a single-side abrasion apparatus with a dresser in which at least one of a plurality of pressing plates to press a work piece applied to an application block on a platen is integrally equipped with a dresser to correct a working face of the platen.

In this invention, it is desirable that the dresser has a ring shape so as to surround the pressing plates.

Moreover, this invention provides a single-side abrasion apparatus in which each of a plurality of pressing plates has a retaining ring in which an application block is fitted and retained, a retaining ring of at least one of the pressing plates also serving as a dresser, and the retaining ring is exposed below the pressing plates when the application block is removed.

Concretely, the dresser includes a correction face portion which is of a base material such as metal or ceramic on which diamond abrasive grains are electrodeposited. Inside the dresser, a cushioning medium is attached in order to contact with the fitted application block in such a way as will not cause a shock to be applied the dresser.

In the case of the single-side abrasion apparatus with a dresser according to this invention having the aforementioned structure, as the pressing plates are integrally equipped with the dresser, the working face of the platen can be corrected by simply lowering the pressing plates and pressing the dresser thereof on the rotating platen; unlike in the case of a conventional abrasion apparatus, there is no need to separately prepare an exclusive dresser and to mount the dresser on, or to remove the dresser from, the pressing plates each time a correction is carried out.

Accordingly, the abrasion apparatus can be operated very easily, and corrections can be done easily and rapidly; and the apparatus is very safe because there is no possibility that an accident associated with the mounting or removal of the heavy dresser will occur. Moreover, it is possible to reduce the labor and space required because storing and keeping the dresser does not require any special care or space.

Because the dresser is ring-shaped to surround the pressing plates, it is extremely lightweight; thus, the dresser can be easily attached to the pressing plates, and this attachment does not cause any trouble.

Finally, since the retaining ring, which is attached to the pressing plates to permit the application block to fit in, doubles as the dresser, there is no need to provide an exclusive dresser; hence, this an extremely reasonable and simple design for the abrasion apparatus is provided.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
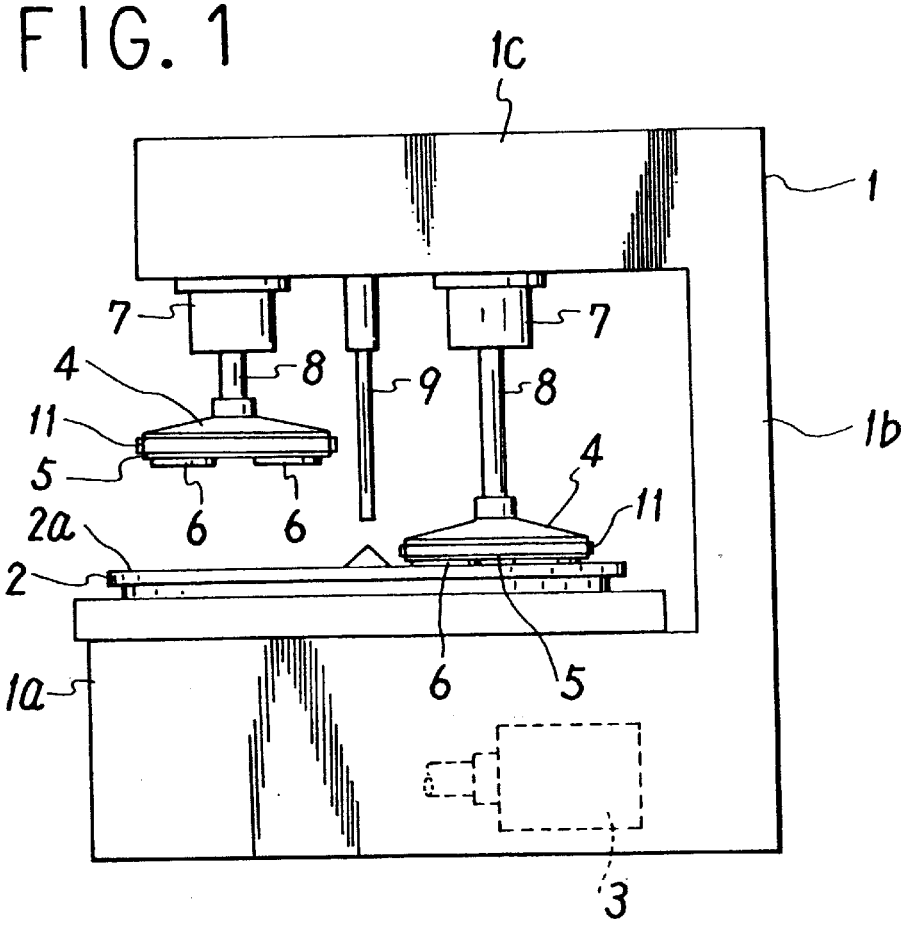
FIG. 1 is a side view of an embodiment of a single-side abrasion apparatus according to this invention.

An embodiment of a single-side abrasion apparatus according to this invention will now be described in detail with reference to the attached drawings. The single-side abrasion apparatus, whose whole structure is shown in FIG. 1, has a body 1 consisting of a base 1*a* set on the ground, a supporting portion 1*b* rising from one end of the base 1*a*, and a beam-like portion 1*c* extending almost horizontally above the base 1*a* with the end thereof supported by the supporting portion 1*b* like a cantilever.

On the base 1*a*, there is a workpiece-abrasion platen 2, which rotates freely on a vertical axis, and a motor 3 which drives the platen 2; the beam-like portion 1*c* has cylinders 7, and each of numerous pressing plates 4 which press a workpiece 6 on the platen 2 at a required processing pressure with an application block 5 in between is mounted on a piston rod 8 of the cylinders 7 in such a way that the plates may be freely raised and lowered; and the beam-like portion 1*c* also has a liquid supply nozzle 9 which supplies abrasive liquid to the center of the platen 2.

An abrasion pad 2*a* is applied to the working face of the platen 2, and the abrasion pad 2*a* mirror-polishes the workpiece 6.

Figure 2:
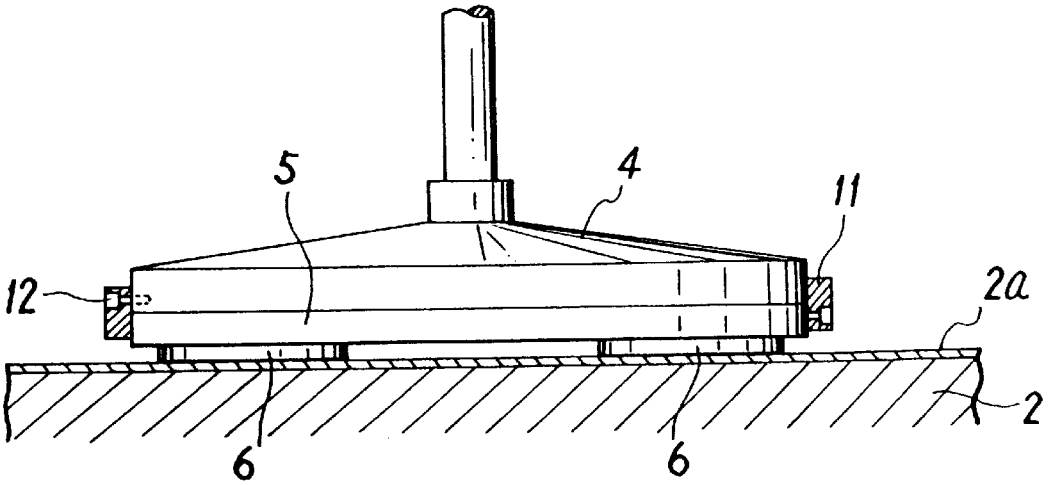
FIG. 2 is an enlarged sectional view of a pressing plate that does not serve as a dresser of the single-side abrasion apparatus shown in FIG. 1.

The application block 5 can be removably fitted to the undersurface of the pressing plates 4. That is, as shown in FIG. 2, around the outer periphery of the circular pressing plates 4, an annular retaining ring 11 made from synthetic resin is fitted with the lower half thereof projecting downward from the pressing plates 4, and is fixed on the pressing plates 4 by bolts 12; and the application block 5 can be attached to the pressing plates 4 if the upper half of the circular application block 5 is fitted in the retaining ring 11.

The application block 5 is made from ceramic, and one workpiece or a plurality of workpieces 6 are applied to the undersurface thereof by such means as wax or the like.

Figure 3:
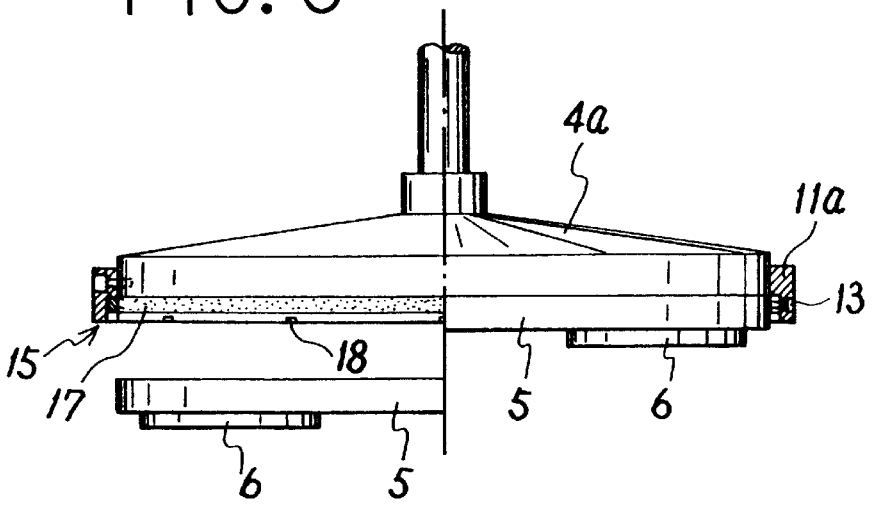
FIG. 3 is an enlarged sectional view of a pressing plate having a dresser of the single-side abrasion apparatus in FIG. 1; the right half of the drawing shows the apparatus with a mounted application block, while the left half of the drawing shows the apparatus with the application block removed.
Figure 4:
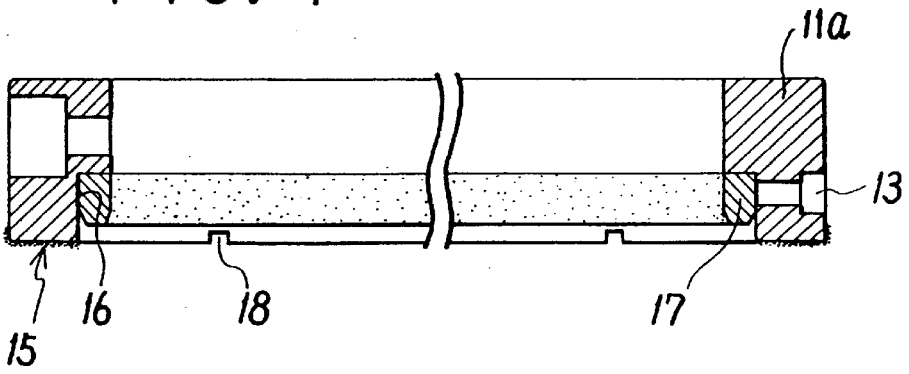
FIG. 4 is an enlarged sectional view of a retaining ring serving as a dresser, with a part thereof omitted.

As shown in FIGS. 3 and 4, on one pressing plate 4*a* of the plurality of pressing plates 4, a retaining ring 11*a* doubles as a dresser to correct the working face of the platen 2. The retaining ring 11*a* doubling as a dresser has a correction face 15 consisting of the undersurface and the lower end of the inner and outer sides of a ring-shaped base material made from metal or ceramic on which diamond abrasive grains are electrodeposited; the inside diameter of a lower half 16 in which the ceramic application block 5 is fitted is larger than that of the other retaining rings 11, a ring-shaped cushioning medium 17 made from synthetic resin or the like is fitted inside the lower half 16 in order to prevent the application block 5 from touching and damaging the inside, and the cushioning medium 17 is fixed by setscrews 13. The cushioning medium 17 is attached in such a way that the lower end thereof is slightly higher than the undersurface of the retaining ring 11*a*, so that the cushioning medium 17 does not cover the correction face 15.

On the undersurface of the retaining ring 11*a* are numerous small notches 18 at appropriate intervals.

In the case of the other pressing plates 4, where no retaining ring 11 doubles as a dresser, as described above, since the retaining rings 11 thereof are formed from synthetic resin such as vinyl chloride and the like, these retaining rings 11 need not have a cushioning medium, unlike the retaining ring 11*a* that doubles as a dresser. The retaining rings 11, however, can be formed from ceramic, metal, and the like. In that case, as in the case of the retaining ring 11*a*, it is desirable that the cushioning medium be provided inside the portion in which the application block 5 is fitted.

In the single-side abrasion apparatus with a dresser having the aforementioned structure, when the workpiece 6 is abraded, as in a usual abrasion apparatus, the work 6 is applied to the undersurface of the application block 5 by means of wax and the like; and the application block 5 is fitted in the retaining rings 11 and 11a of the pressing plates 4 and 4*a*, respectively. The workpiece 6 is pressed on the rotating platen 2, with the application block 5 in between, by the pressing plates 4 and 4*a* at a required processing pressure, and is thus abraded. At this time, an abrasive liquid is supplied by a liquid supply nozzle 9.

Figure 5:
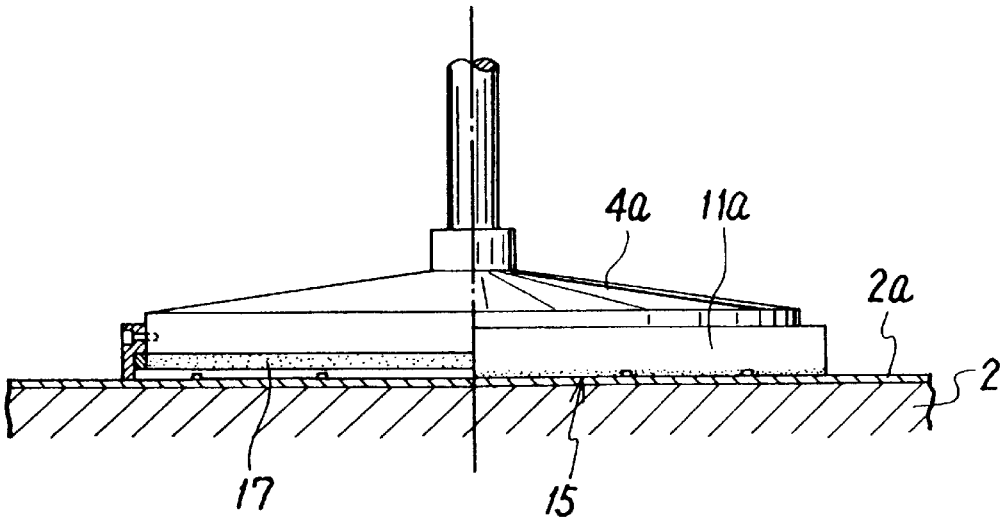
FIG. 5 is a sectional view illustrating a platen corrected by pressing plates that have a dresser.

When the working face of the platen 2 is corrected, the pressing plate 4*a* having the retaining ring 11*a* that doubles as a dresser, as shown on the left side of FIG. 3, the application block 5 is removed from the retaining ring 11*a*; and the retaining ring 11*a*, which is the undersurface of the dresser, is exposed below the pressing plates 4. Moreover, as shown in FIG. 5, the pressing plate 4*a* is lowered and the correction face 15 on the undersurface of the retaining ring 11*a* contacts the working face of the platen 2, and the platen 2 is rotated and corrected. While processing, the other pressing plates 4 may be in the middle of a process, or may also be at a higher position since they are not being processed.

Thus, if the pressing plates are integrally equipped with a dresser, the working face of the platen 2 can be corrected only if the pressing plates are lowered, and the dresser thereof is pressed on the rotating platen 2. Unlike in the case of conventional abrasion apparatuses, there is no need to separately prepare an exclusive dresser and to mount said dresser or to remove said dresser from the pressing plates each time a correction is carried out. Accordingly, the abrasion apparatus can be operated very easily, and corrections can be done easily and rapidly; moreover, the apparatus is very safe because there is no possibility that an accident associated with the mounting or removal of the heavy dresser will occur. Finally, it is also possible to reduce the labor and space required because storing and keeping the dresser does not require any special care or space.

Since the dresser is made in such a way that the dresser may form a ring so as to surround the pressing plate 4*a*, it is extremely lightweight, and its structure is simple. Thus, it can be easily mounted on the pressing plate 4*a*.

In addition, as the retaining ring in which the application block 5 is fitted doubles as a dresser, there is no need to separately provide an exclusive dresser; thus, the abrasion apparatus can have a very reasonable and simple design.

Although in the aforementioned example, one of the numerous pressing plates 4 has a retaining ring that doubles as a dresser, two or more pressing plates may have a similar dresser, and if necessary, all the pressing plates may have a dresser doubling as a retaining ring.

The retaining ring need not double as a dresser. It is possible to provide pressing plates with an exclusive dresser surrounding the retaining ring or, in the case of an abrasion apparatus with pressing plates that do not have the retaining ring described above, it is possible to provide at least one of the pressing plates with an exclusive dresser with a ring shape or some other shape.

Needless to say, the technical ideas behind this invention can be applied not only to an abrasion apparatus in which an abrasion cloth is applied to the working face of the platen, but also to other abrasion apparatuses that do not use an abrasion cloth.

Thus, according to this invention, since there is no need to mount a dresser on or to remove a dresser from the pressing plates each time the working face of the platen is corrected, the abrasion apparatus can be operated very easily, and corrections can be done easily and rapidly.

Moreover, the apparatus is extremely safe because there is no possibility that an accident associated with the mounting or removal of the heavy dresser will occur. Finally, it is possible to reduce the labor and space required because storing and keeping the dresser does not require any special care or space.

Furthermore, by having the retaining ring, a member on which the application block is fitted, which doubles as a dresser, there is no need to separately provide an exclusive dresser. Hence, the design of the abrasion apparatus is very reasonable and simple.

It is claimed:

1. A single-sided abrasion apparatus with a dresser, which comprises:

a platen that is driven and freely rotated by a motor, an application block to which a workpiece to be abraded is applied, and at least one pressing plate mounted on the application block which presses the workpiece on the platen with the application block being positioned between the pressing plate and the workpiece wherein at least one of the pressing plates comprises a dresser to contact the working face of the platen, said dresser being exposed when the application block is removed.

2. The single-sided abrasion apparatus according to claim 1, wherein said dresser comprises a ring shaped dresser which is mounted on an outer surface portion of the at least one pressing plate in such a way as to surround the at least one pressing plate mounted on said application block.

3. The single-side abrasion apparatus according to claims 1 or 2, wherein said dresser comprises a base material made of one of a metal and a ceramic material wherein diamond abrasive grains are electrodeposited on a portion of said base material so as to form a correction face member for contacting said platen.

4. A single-sided abrasion apparatus with a dresser which comprises:

a platen that is driven and freely rotated by a motor, an application block to which a workpiece to be abraded is mounted, and at least one pressing plate which presses the workpiece on the platen with the application block being positioned between the pressing plate and the workpiece, said pressing plate having a retaining ring in which the application block is fitted and retained, the retaining ring of the at least one pressing plate doubling as a dresser to contact the working face of the platen, and said dresser being exposed below the at least one pressing plate when the application block is removed.

5. The single-side abrasion apparatus according to claim 4, which comprises a cushioning member which is attached to a radially inner portion of said dresser and is located between the fitted application block and the dresser to prevent the application block from contacting a lower portion of said dresser.

* * * * *